US007465865B2

(12) United States Patent
Terao

(10) Patent No.: US 7,465,865 B2
(45) Date of Patent: Dec. 16, 2008

(54) SOUND GENERATION ASSIGNMENT DEVICE, MUSIC SOUND GENERATOR AND SOUND GENERATION ASSIGNMENT PROCESS PROGRAM

(75) Inventor: Ken Terao, Iruma (JP)

(73) Assignee: Casio Computer Co., Ltd., Tokyo (JP)

( * ) Notice: Subject to any disclaimer, the term of this patent is extended or adjusted under 35 U.S.C. 154(b) by 257 days.

(21) Appl. No.: 11/378,654

(22) Filed: Mar. 16, 2006

(65) Prior Publication Data

US 2006/0213355 A1 Sep. 28, 2006

(30) Foreign Application Priority Data

Mar. 28, 2005 (JP) ..... 2005-090371

(51) Int. Cl.
*G10H 1/00* (2006.01)

(52) U.S. Cl. ..... 84/600; 84/601; 84/645

(58) Field of Classification Search ..... 80/600–602, 80/615, 653, 645
See application file for complete search history.

(56) References Cited

U.S. PATENT DOCUMENTS 4,706,538 A 11/1987 Yoshida et al.
5,410,099 A 4/1995 Kosugi et al.
5,652,400 A * 7/1997 Fujimori et al. ..... 84/600
5,804,755 A * 9/1998 Furukawa ..... 84/656
7,109,406 B2 * 9/2006 Stone et al. ..... 84/609
2001/0028708 A1 * 10/2001 Tanaka et al. ..... 379/156
2005/0076770 A1 * 4/2005 Stone et al. ..... 84/609
2006/0236848 A1 * 10/2006 Stone et al. ..... 84/615

FOREIGN PATENT DOCUMENTS

EP 1 087 372 A2 3/2001
JP 2562260 B2 8/1993
JP 8-202361 A 8/1996

* cited by examiner

*Primary Examiner*—David S. Warren
(74) *Attorney, Agent, or Firm*—Frishauf, Holtz, Goodman & Chick, P.C.

(57) ABSTRACT

A CPU sets an application of music sound generation to each of plural ports, and a priority to the set application, and further sets the maximum number of channels that assign an arbitrary sound source to each port from plural kinds of sound sources and produce sounds. When a new sound generation request is supplied to a certain port in which all sound generation channels of the port are currently generating sounds, and when the sound generation channels to be used for the sound generation are in short, the CPU supplies the sound generation request to a channel not producing a sound currently in other port to which the application of the same priority is set.

12 Claims, 7 Drawing Sheets

SOUND GENERATION ASSIGNMENT DEVICE, MUSIC SOUND GENERATOR AND SOUND GENERATION ASSIGNMENT PROCESS PROGRAM

CROSS-REFERENCE TO RELATED APPLICATIONS

This application is based upon and claims the benefit of priority from prior Japanese Patent Application No. 2005-090371, filed Mar. 28, 2005, the entire contents of which are incorporated herein by reference.

BACKGROUND OF THE INVENTION

1. Field of the Invention

The present invention relates to a sound generation assignment device, a music sound generator and a sound generation assignment process program.

2. Description of the Related Art

In a music sound generator such as an electronic music instrument, a plurality of sound generation channels are assigned to a port, and a timbre of music sound is set to each sound generation channel and sounds are produced at the same time. For example, according to the MIDI 1.0 Specification, generators (sound sources) can be assigned to 16 channels at maximum to one port, and music sounds can be produced with 16 kinds of timbres at the same time. Further, in recent years, generators of 32 kinds or 64 kinds of timbres are shared by a plurality of ports, and generators are assigned to a plurality of sound generation channels of each port. For example, melody part, rhythm part, chord part, and bass part as plural parts of a music piece are set to each port as applications of music sound generation, and thereby polyphonic and richly music sounds can be generated. On the other hand, there is a case in which the number of channels to which generators of a part as an arbitrary application are assigned may be in short to music sound data input from a music keyboard or other external MIDI devices. In such a case, sound generation channels of other parts are used temporarily.

However, with regard to musically important parts, for example the melody part, a priority is set for each port so that even if the sound generation channels of other parts are in short, the sound generation channels of the melody part are not be used as the sound generation channels for ones that are temporarily in short. More specifically, in the case where a new sound generation is required to a part having a high priority, and there is no empty sound generation channel in the part, a generator of a sound generation channel currently producing a sound in a part having a low priority is muted and made as an empty sound generation channel, and the empty channel is assigned to a new sound generation to the part having the high priority.

Further, in recent years, a music sound generator is arranged inside of a mobile communication terminal such as a cellular phone, and thereby ringtone melodies (call signals with melodies), game artificial sounds, reproduced sounds of music pieces downloaded from a network and the like are produced. Cellular phones evolve year by year, and accordingly, it is forecasted that in the near future, musical performances at the same level of those in an electronic music instrument will be required to cellular phones.

In an electronic music instrument disclosed in Jpn. Pat. Appln. KOKAI Publication No. 8-202361, it is determined whether or not there is an empty sound generation channel when a sound generation timing comes in. In the case where there is no empty channel, it is determined whether or not there are sound generation channels currently producing sounds in the part from the part having the highest mute priority. Then, in the part where sound generation channels currently producing sounds have been detected, one channel currently producing a sound is selected in accordance with a predetermined condition, the sound generation of the sound generation channel is stopped, and the released sound generation channel is assigned to new key-on information. Further, in the above publication, there is described a configuration that enables to change the mute priority, by a user operation, a command in automatic playing data, an exclusive message of MIDI, and the like. According to this configuration, even if the number of sound generation channels becomes in short, necessary sounds are not deleted.

Furthermore, an assigner of an electronic music instrument is disclosed in Japanese Patent No. 2562260. When playing data for playing one of plural parts is newly input, a sound generation channel to which the new playing data is assigned is selected. At this time, if the sound generation channel to which the new playing data is assigned is in short, a sound generation channel is selected from the sound generation channels to which parts of low priorities are assigned according to priorities of parts stored in a memory. With this configuration, the number of sound generation channels that each part uses is not assigned fixedly to each part. For this reason, the newly input part can obtain the necessary number of sound generation channels, and sounds to be played are not limited, so that it is possible to make music performance expressions richer.

In Jpn. Pat. Appln. KOKAI Publication No. 8-202361 and Japanese Patent No. 2562260, the part whose priority is set low is always sacrificed in the case where, when there is a request for new sound generation to a certain part, the sound generation channel to be used for the sound generation is in short. However, there is a case in which a priority cannot be made to applications set to respective plural ports. For example, recent cellular phones have a function to play a game by use of polyphonic music sounds, and a user may want to receive a call without stopping a game when there is a call signal during playing the game. However, in the case where the priority of the port set for the application of receiving a call signal is low, the call cannot be recognized. On the contrary, in the case where the priority of the port set for the application of playing the game is low, the game is terminated.

Meanwhile, in the electronic music instrument disclosed in Jpn. Pat. Appln. KOKAI Publication No. 8-202361, a plurality of parts or sound generation channels may be assigned to one priority. A sound generation channel to be muted may be selected from the part having the largest number of sound generation channels in a same priority, and sound generation channels of each part may be selected sequentially. However, this configuration is substantially same as a configuration in which a part or a sound generation channel is assigned to one priority. Accordingly, even if a plurality of parts or sound generation channels are assigned to a priority, a part whose priority is set low is always sacrificed.

BRIEF SUMMARY OF THE INVENTION

One aspect of the present invention has a configuration as follows. To each of plural ports to which applications of music sound generation are set respectively, a priority and the maximum number of sound generation channels that assign arbitrary generators to each port from plural generators of sound sources and produce sounds are set. When there is a new sound generation instruction to an arbitrary port, the channels to be used for sound generation may be in short owing to this addition of sound generation. In this case, the generator corresponding to the sound generation instruction is assigned to a sound generation channel not producing a sound currently in other ports to which an application of the same priority is set.

DETAILED DESCRIPTION OF THE INVENTION

Embodiments of a music sound generator according to the present invention will be illustrated in more details with reference to the accompanying drawings hereinafter.

Figure 1:
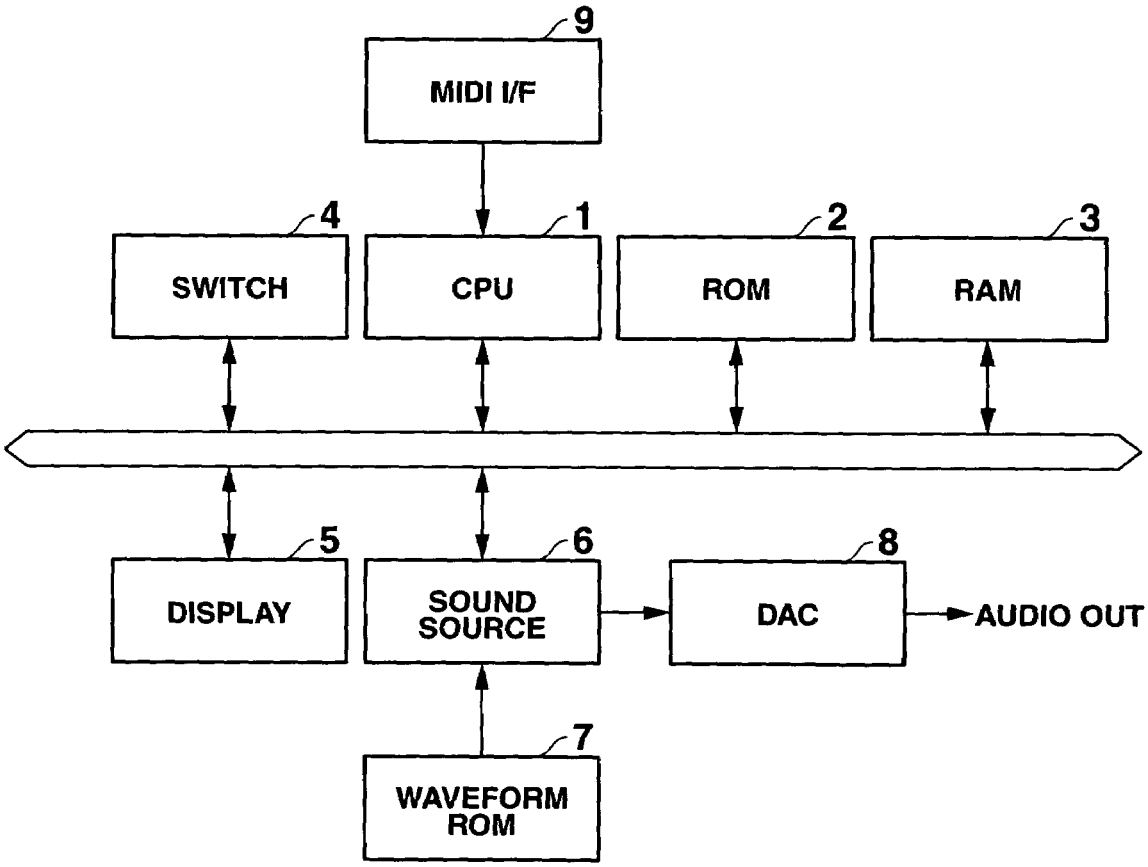
FIG. 1 is a block diagram showing a configuration of a music sound generator according to one embodiment of the present invention.

FIG. 1 is a block diagram showing a configuration of a music sound generator according to one embodiment of the present invention. A CPU 1 is connected via a system bus to a ROM 2, a RAM 3, a switch 4, a display 5, and a sound source 6. The CPU 1 sends and receive commands and data to and from these components, and thereby controls this music sound generation. For example, the sound source 6 has MAX_ GEN pieces of generators. In response to a sound generation instruction from the CPU 1, the sound source 6 reads waveform data from a waveform ROM 7 and generates music sound signals, and converts the signals into analog audio output signals by a D/A converter (DAC) 8, thereby sending the analog audio output signals to a sound system (not shown) and performing a mute process at a mute instruction from the CPU 1.

The CPU 1 has sound generation channels corresponding to the MAX_GEN pieces of generators. By MAX_PORT pieces of plural MIDI IN ports, MIDI data requesting for sound generation from an external MIDI device such as a music keyboard is received via a MIDI interface (I/F) 9. Further, the maximum number of applications of music sound generation and generators that can be used to each port, namely, the maximum number of usable sound generation channels is set therein.

When the variable alignment of the maximum number of simultaneously generated sounds in the MAX_PORT pieces of ports is defined as max_poly[ ], the variable alignment of each port from 0 to MAX_PORT-1 is expressed by max_poly[0] to max_poly[MAX_PORT-1]. Examples of applications to each port include, in the case of a cellular phone, the application of plural kinds of ringtone melodies wherein melodies change according to senders, the application of plural kinds of game artificial sounds, the application of playing music pieces, and the application of switch operation sounds.

Further, when the variable alignment of the number of sound generation channels currently generating sounds in the MAX_PORT pieces of ports is defined as crnt_poly[ ], the variable alignment of each port from 0 to MAX_PORT- is expressed by crnt_poly[0] to crnt_poly[MAX_PORT-1].

Furthermore, when the variable alignment of the priority in the MAX_PORT pieces of ports is defined as priority[ ], the variable alignment of each port from 0 to MAX_PORT-1 is expressed by priority[0] to priority[MAX_PORT-1].

Next, the operation of the music sound generator in FIG. 1 will be explained with reference to the flow charts shown in FIGS. 2 to 7 hereinafter.

Figure 2:
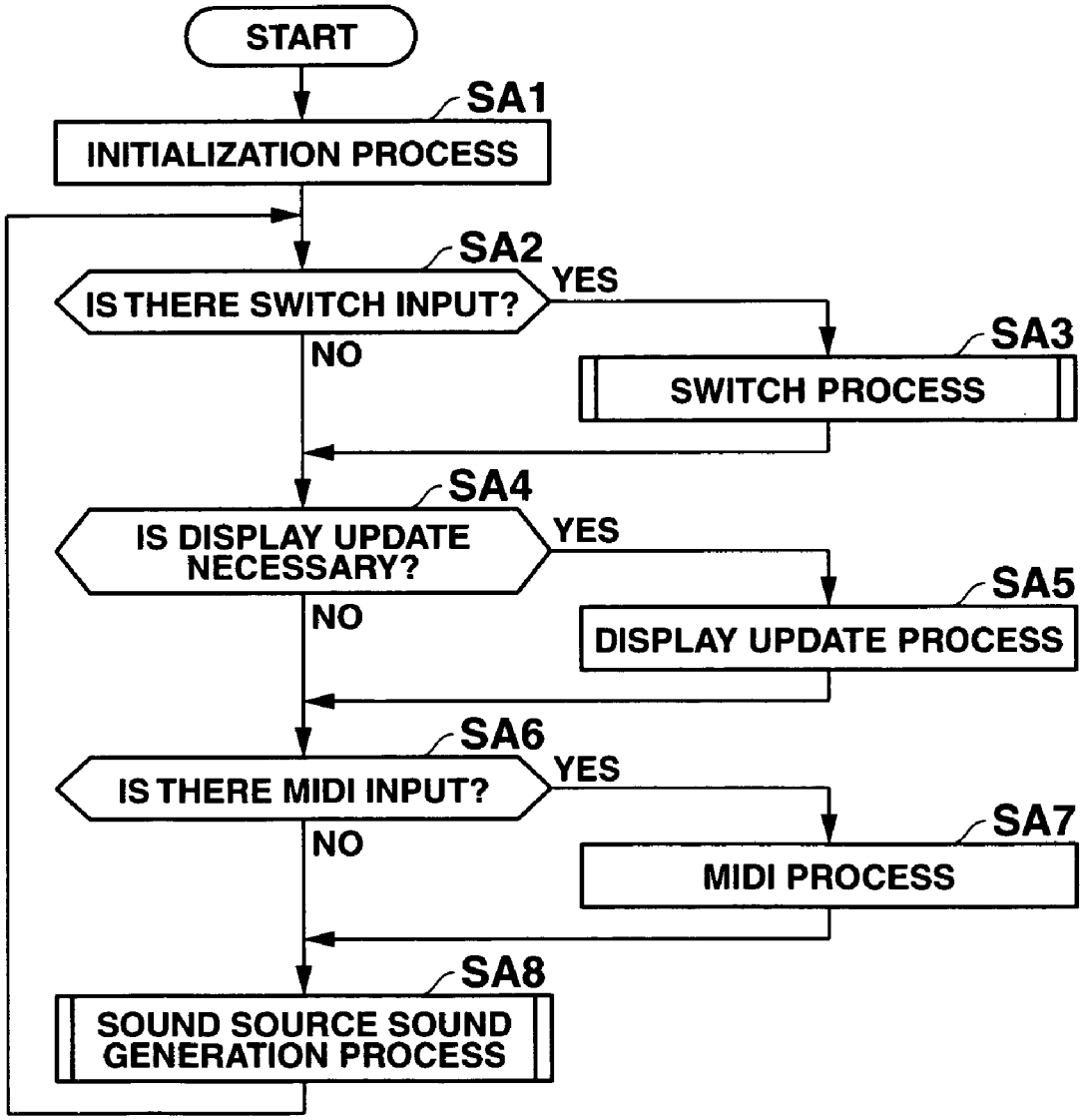
FIG. 2 is a flow chart of a main routine of a CPU in FIG. 1.

FIG. 2 is a flow chart of a main routine of the CPU in FIG. 1. First, the CPU performs an initialization process (step SA1). In the initialization process, MAX_GEN is set to all the variable alignments max_poly[0] to max_poly[MAX_PORT-1] of the maximum number of simultaneously generated sounds in each port; 0 is set to all the variable alignments crnt_poly[0] to crnt_poly[MAX_PORT-1] of the number of sound generation channels currently generating sounds of each port; and 0 is set to all the variable alignments priority[0] to priority[MAX_PORT-1] of the priority of each port.

After the initialization process, the CPU repeats a loop process from step SA2 to step SA8. The CPU determines where there is a switch input or not (step SA2), and if there is a switch input, the CPU performs a switch process (step SA3). The switch process will be described in more details later. The CPU determines whether a display update is necessary or not (step SA4), and if a display update is necessary, the CPU performs a display update process (step SA5). For example, when a setting is changed by the switch process, the CPU displays the contents of the change. The CPU determines whether there is a MIDI input or not (step SA6), and if there is a MIDI input, the CPU performs a MIDI process (step SA7). The MIDI process includes there are a sound generation instruction, a mute instruction, an effect instruction and the like. Next, the CPU performs a sound source sound generation process (step SA8). The sound source sound generation process will be described in more details later.

Figure 3:
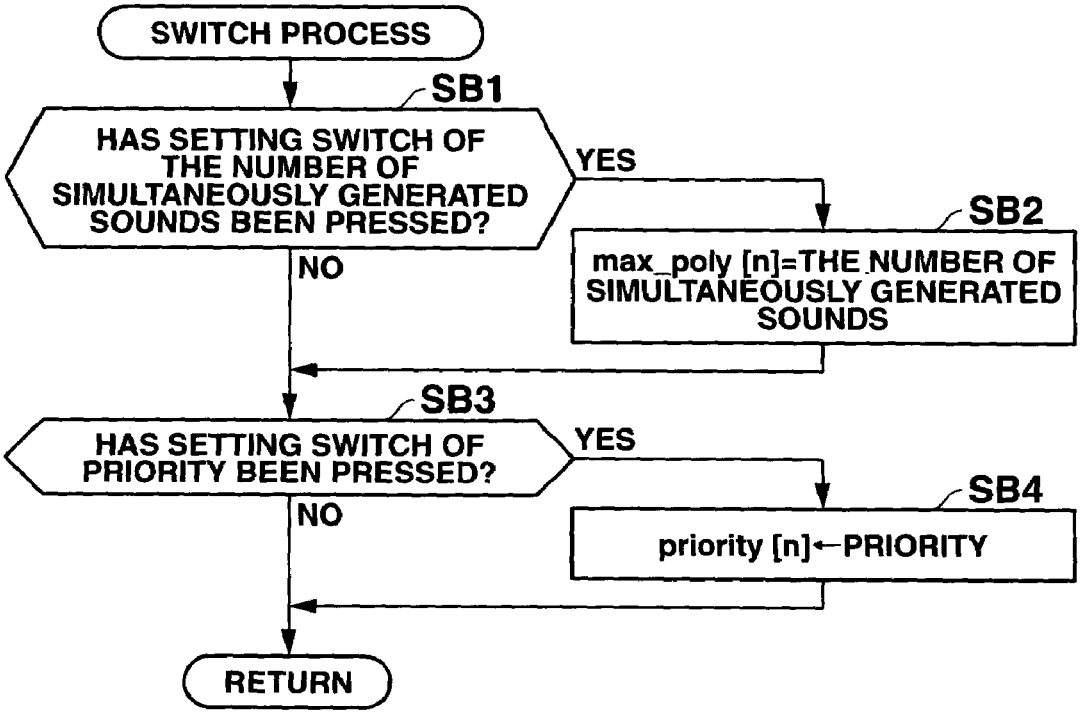
FIG. 3 is a flow chart of a switch process in FIG. 2.

FIG. 3 is a flow chart of the switch process in step SA3 of the main routine. The CPU determines whether the setting switch of the number of simultaneously generated sounds of a designated port n has been pressed or not (step SB1), and if this switch has been pressed, the CPU sets the number of simultaneously generated sounds set to max_poly[n] (step SB2). Then, the CPU determines whether the setting switch of the priority of the designated port n has been pressed or not (step SB3), and if this switch has been pressed, the CPU sets the priority set to priority[n] (step SB4). Meanwhile, with regard to the priority, as the numeric value to be set is smaller, the priority is higher.

In the case of, for example, a cellular phone, suppose that four ports 0 to 3 are set to an application of ringtone melodies (port 0), an application of games (port 1), an application of playing music pieces (port 2), and an application of switch operations (port 3), respectively. When 32, 32, 32, and 8 are set to the ports 0 to 3 as the numbers of simultaneously generated sounds, and 0, 0, 1, and 2 are set thereto as the priorities, the variable alignment becomes as follows.

max_poly[0]=32
max_poly[1]=32
max_poly[2]=32
max_poly[3]=8
priority[0]=0
priority[1]=0
priority[2]=1
priority[3]=2

As shown in this example, a same priority may be set to a plurality of ports.

Figure 4:
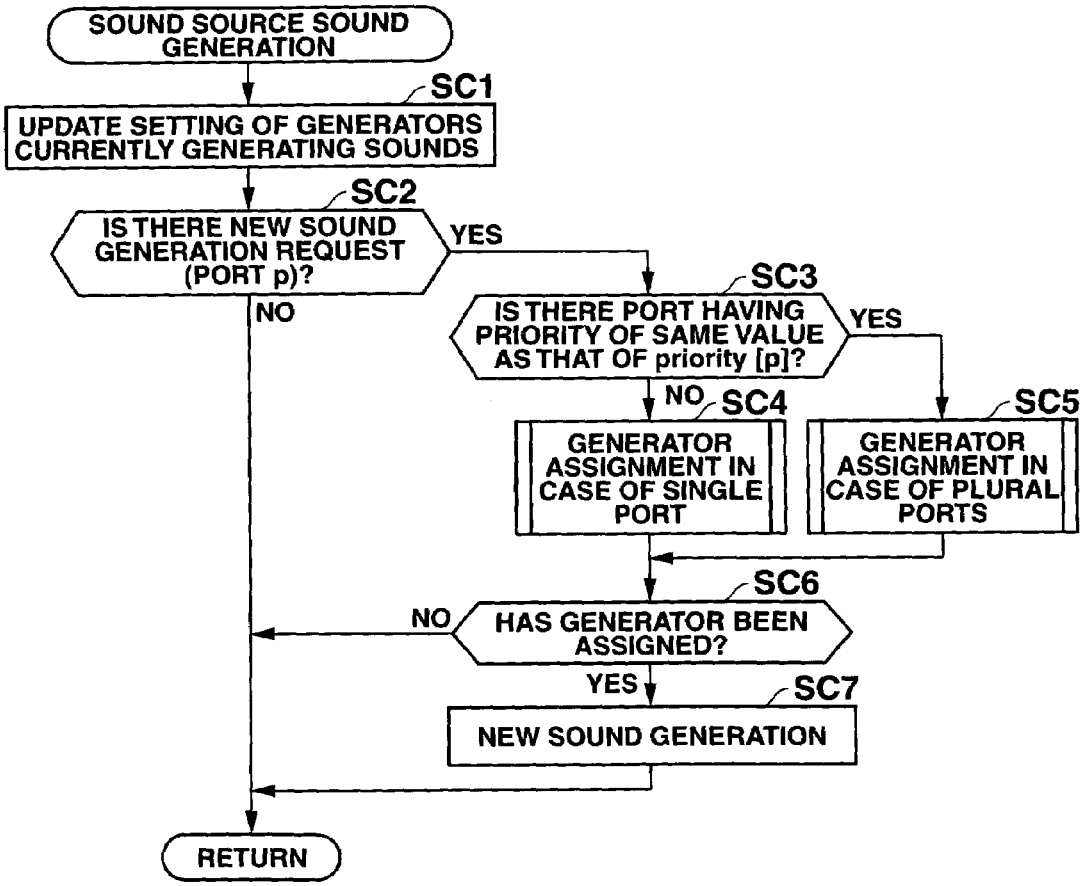
FIG. 4 is a flow chart of a sound source sound generation process in FIG. 2.

FIG. 4 is a flow chart of the sound source sound generation process in step SA8 of the main routine in FIG. 2. First, the CPU performs a control to update the tone and the volume to generators currently generating sounds assigned to channels of each port (step SC1). Next, the CPU determines whether there is a new sound generation request to an arbitrary MIDI IN port p or not (step SC2). If there is no new sound generation request, the CPU goes back to the main routine, but when there is a new sound generation request, the CPU determines whether there is a port having the priority of the same value as that of priority[p] of the port or not (step SC3). If there is no port having the priority of the same value, the CPU performs a generator assignment in the case of a single port (step SC4). On the other hand, if there is a port having the priority of the same value, the CPU performs a generator assignment in the case of plural ports (step SC5). After performing one of the above generator assignments, the CPU determines whether a generator has been assigned to the channel of the corresponding port or not (step SC6). If a generator has been assigned, the CPU instructs the sound source 6 to generate a new sound by the channel (step SC7). After instructing the sound generation, or, when a generator has not been assigned to the sound generation channel of the corresponding port, the CPU goes back to the main routine.

Figure 5:
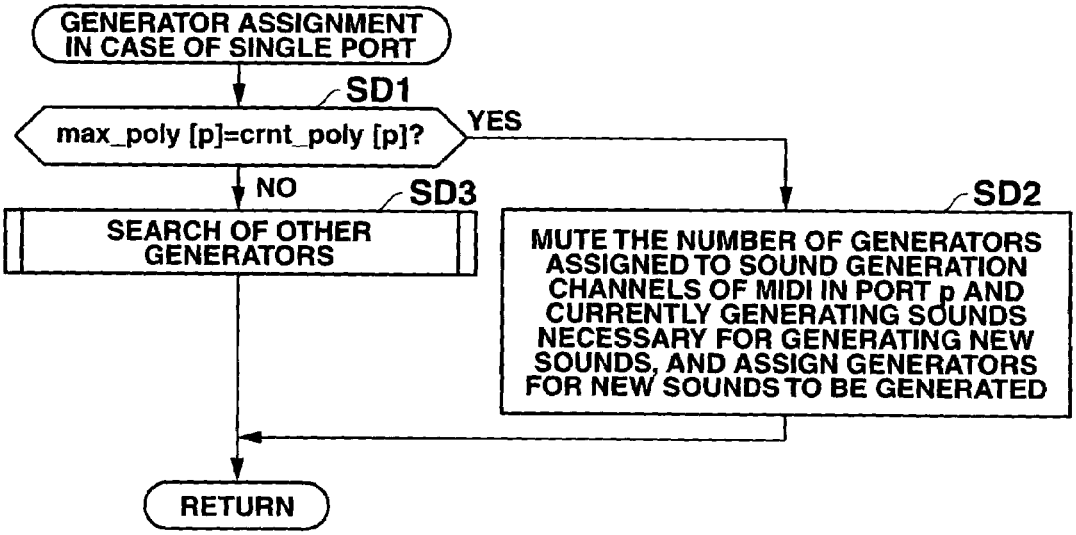
FIG. 5 is a flow chart of a generator assignment process with a single port in FIG. 4.

FIG. 5 is a flow chart of the generator assignment process with a single port in step SC4 in FIG. 4. First, the CPU determines whether max_poly[p] of the port p and crnt_poly [p] are same or not (step SD1). Namely, the CPU determines whether or not generators have been assigned to all the sound generation channels of the MIDI IN port p, and the port p has reached the maximum number of sounds to be generated. If the port p has reached the maximum number of sounds to be generated, and there is no empty sound generation channel to which a new generator is assigned, the CPU mutes the number of generators assigned to the sound generation channels of the MIDI IN port p and currently generating sounds necessary for generating new sounds, and assigns generators for the new sounds to be generated (step SD2). Namely, in the case where an arbitrary port has reached the maximum number of sounds to be generated, and there is not any empty sound generation channel at all, a new sound generation may be requested to the port. In this case, the CPU adjusts the sound generation channels only in the port, and assigns generators for the new sounds to be generated, irrespective of the sound generation conditions of other ports.

On the other hand, in the case where the generators assigned to all the sound generation channels of the MIDI IN port p have not reached the maximum number of sounds to be generated, and there is an empty sound generation channel to which a generator is not assigned, the CPU performs a search process of another generator (step SD3). Namely, the CPU searches for the number of channels necessary for the new sound generation, inclusive of empty sound generation channels of the port p.

Figure 6:
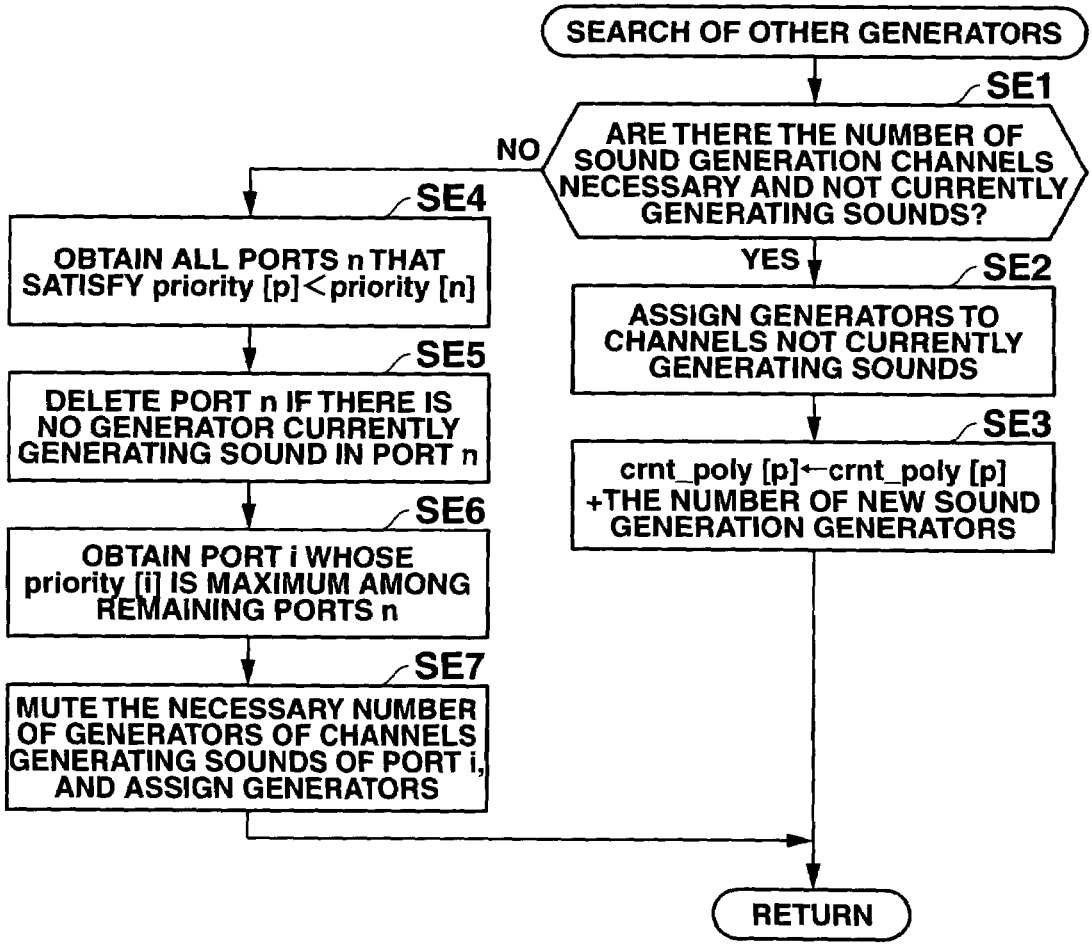
FIG. 6 is a flow chart of a search process of another generator in FIG. 5.

FIG. 6 is a flow chart of the search process of another generator. The CPU determines whether or not there are the necessary number of sound generation channels not currently generating sounds in the port p that is requested to generate a new sound (step SE1). If there are the necessary number of sound generation channels, the CPU assigns generators to the channels not currently generating sounds for the new sound generation (step SE2), and adds the number of new sound generation generators to crnt_poly[p] (step SE3). Then, the CPU goes back to the main routine.

On the other hand, if, in step SE1, there are not the necessary number of channels not currently generating sounds in the port p, the CPU obtains all the ports n that satisfy priority [n] of the priority lower than priority[p] of the port p (step SE4). If there is no generator currently generating sound in the sound channels of the port n, the CPU deletes the port n (step SE5). The CPU obtains port i whose priority [i] is maximum (whose priority is lowest) among the remaining ports n (step SE6). Then, the CPU mutes the necessary number of generators of channels currently generating sounds of the port i, and assigns the generators for the new sound generation (step SE7). Then, the CPU goes back to the main routine.

Now, the above case of the cellular phone is taken as an example. With the application of ringtone melodies (port 0), the application of games (port 1), the application of playing music pieces (port 2), and the application of switch operations (port 3), the maximum number of sounds to be generated (the maximum number of channels) of the port 2 for playing music pieces is 32 and the priority thereof is 1. Now, assuming that the number of generators currently generating sounds in the sound generation channels of the port 2 is 28. When a new sound generation request is further made, there is no other port whose priority is same as priority[2]=1 of the port 2. In this case, the generation assignment with a single port is made. In this case, when the number of necessary generators is four, the new sound generation is taken by only the port 2. However, when the number of necessary generators is eight, the CPU mutes four generators currently generating sounds in the port 3 of the low priority priority[2]=2, and assigns the empty sound generation channels for the new sound generation of the port 2.

Figure 7:
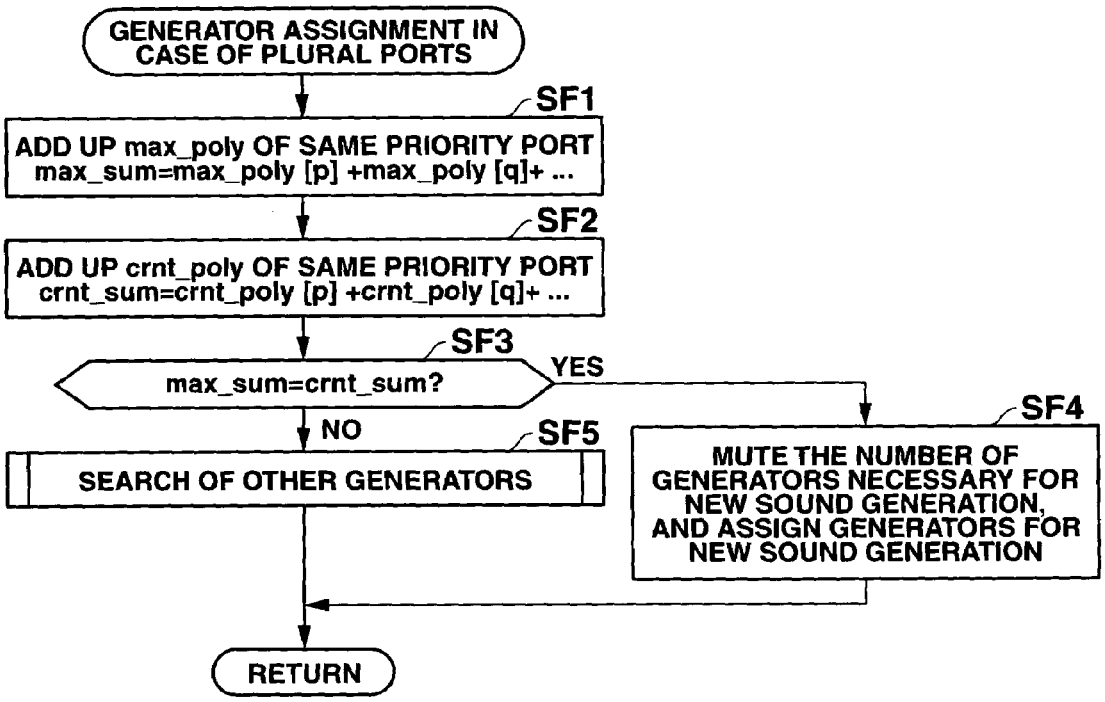
FIG. 7 is a flow chart of a generator assignment process with plural ports in FIG. 4.

FIG. 7 is a flow chart of the generator assignment process with plural ports in FIG. 4. In the generator assignment in this case, the CPU adds up max_poly[p] and max_poly[q] as the respective maximum numbers of sounds to be generated of the port p and the port q of the same priority as that thereof, and stores the sum into a variable max_sum (step SF1). Next, the CPU adds up crnt_poly[p] and crnt_poly[q] as the channels currently generating sounds respectively in the port p and the port q, and stores the sum into a variable crnt_sum (step SF2). Then, the CPU determines whether the value of the max_sum and the value of the crnt_sum are same or not (step SF3). Namely, the CPU determines whether or not the total number of generators currently generating sounds in the port p and the port q has reached the total maximum number of sounds to be generated (the maximum number of channels). If the total number of generators currently generating sounds has reached the total maximum number of sounds to be generated, the CPU mutes the number of generators necessary for the new sound generation, from the generators that have started counting the crnt_sum, and assigns the generators for the new sound generation (step SF4). Then, the CPU goes back to the main routine. More specifically, when there is not any empty sound generation channel not currently generating a sound in the port p and the port q at all, channels are adjusted only in the port p and the port q for the new sound generation, without sacrificing any other port of a low priority.

On the other hand, if the total number of generators currently generating sounds has not reached the total maximum number of sounds to be generated, the CPU performs a search process of other generators shown in FIG. 6, in the same manner as in the generator assignment with a single port (step SF5). Then, the CPU goes back to the main routine.

Now, the above case of the cellular phone is taken as an example. With the application of ringtone melodies (port 0), the application of games (port 1), the application of playing music pieces (port 2), and the application of switch operations (port 3), the maximum number of sounds to be generated (generators) of the port 0 for ringtone melodies is 32 and the priority thereof is 0. Now, when the number of generators currently generating sounds in the sound generation channels of the port 0 is 28, and further a new sound generation request is made, there is the port 1 whose priority is same as priority [0]=0 of the port 0. In this case, the generation assignment with plural ports is made. In this case, when the number of necessary generators is eight, the new sound generation is taken by only the port 0 and the port 1. However, when the number of necessary generators is 16, the CPU mutes eight generators currently generating sounds in the port 3 of the low priority priority[2]=2, and assigns the generators for the new sound generation of the port 0. When the number of necessary generators is 24, the CPU mutes eight generators currently generating sounds in the port 3 of the low priority priority[2] =2. Further, the CPU mutes eight generators currently generating sounds in the port 2 of the low priority priority[2]=1, searches for 16 generators in short from the port 3 and the port 2, and assigns the generators for the new sound generation of the port 0.

As explained above, according to the present preferred embodiment, the CPU 1 sets the application of music sound generation to each of plural ports, sets the priority to the set application, and further, sets the maximum number of channels that assign arbitrary sound sources to each port from plural kinds of sound sources and produce sounds. In the case where, when there is a new sound generation request to an arbitrary port, the channels to be used for the sound generation are in short owing to this addition of the sound generation, the CPU assigns channels not producing a sound currently in other ports to which the application of the same priority is set to the sound generation channel in short.

In the case where applications are set to each of plural ports, there may be a new sound generation request to a certain port. In this case, even if the sound generation channels of the port are in short, it is possible to respond to a new sound generation request while reducing the probability that other ports are sacrificed.

In this case, when there is a request to add new sound generation to an arbitrary port, the CPU 1 adds up sound generation channels not currently generating sounds in other port to which the application of the same priority as that of the sound generation channels not currently generating sounds in the port, and assigns the generators to the channels in short.

Accordingly, in the case where there is a new sound generation request to a certain port, and the sound generation channels of the port are in short, it is possible to make up for channels among ports of a same priority, and prevent other ports of a low priority from being sacrificed blindly.

Moreover, when there is a request to add new sound generation to an arbitrary port, and the port is already generating sounds by the maximum number of sound generation channels, the CPU 1 mutes the sounds to be generated of the channels in the port and assigns the channels to the channels in short.

Consequently, in the case where there is a new sound generation request to a certain port, and there is not any empty sound generation channel in the port at all, there is no need to back up the port by sacrificing other ports, so that the CPU makes up for sound generation channels only within the port and respond to the new sound generation request.

Furthermore, when the sound generation channels not currently generating sounds in other ports to which an application of the same priority is assigned cannot make up for all the sound generation channels in short, the CPU 1 assigns the sound generation channels in other ports to which an application of the priority lower than the same priority to the sound generation channels that cannot be made up for.

Accordingly, in the case where there is a new sound generation request to a certain port, the occurrence of the condition wherein the new sound generation request cannot be responded even by adding up the empty channels of the port and the empty sound generation channels of other ports of the same priority as that thereof is scarce. In addition, there is no significant problem in sacrificing other ports of a low priority temporarily, and therefore, the channels in short are made up for by the sound generation channels of other ports of a low priority.

Meanwhile, in the above embodiment, the present invention has been explained by taking up a music sound generator of a configuration in which an application of music sound generation is set to each of plural ports as an example. However, instead of such physically separated ports, the present invention may be applied also to a configuration in which a common port is used in time-sharing manners as substantially plural ports.

In the above embodiment, the invention of the device in which the CPU 1 performs a music sound generation process program stored in advance in the ROM 2 has been explained. However, the present invention may be embodied also by a system obtained by combining a general purpose personal computer and a music keyboard. That is, a music sound generation process program stored in a recording medium such as a flexible disk (FD), a CD and an MD, or a music sound generation process program downloaded from a network such as internet may be installed into a nonvolatile memory such as a hard disk or a flash memory in a personal computer, and the personal computer may perform the program. In this case, an invention of a program and an invention of a recording medium having the program recorded therein may be embodied.

More specifically, the music sound generation process program according to the present invention is a music sound generation process program which is applied to a music sound assignment device comprising: a plurality of sound generation channels to each of which any of a plurality of generators that a sound source connected thereto has is assigned when a sound generation instruction is supplied; and a plurality of input ports to each of which an application of music sound generation is set and a sound generation instruction from outside is input. The program causes the music sound assignment device to perform: a priority setting procedure of setting a priority to each set application; a maximum channel number setting procedure of setting the maximum number of sound generation channels assignable to each port; and a channel adjusting procedure of, in the case where, when there is a new sound generation instruction input to an arbitrary port, there are sound generation channels to which generators are not assigned in the maximum number of sound generation channels belonging to the arbitrary port, assigning the generators corresponding to the sound generation request to the sound generation channels to which generators are not assigned, and when generators are assigned to all the sound generation channels, assigning the generators corresponding to the sound generation request to the sound generation channels to which generators are not assigned, the sound generation channels belonging to another port to which an application of the same priority as that of the arbitrary port.

There may be a case in which, when there is a new sound generation request to the arbitrary port, the maximum number of sound generation channels assigned to the port are all currently generating sounds, and there is no any other port to which the application of the same priority is set. In this case, the channel adjusting procedure stops the sound generation of the sound generation channels already generating sounds in the port, and supplies the new sound generation request to the sound generation channels whose sound generation is stopped.

In the case where all the sound generation channels in other ports to which the application of the same priority is set are currently generating sounds, the channel adjusting procedure supplies the new sound generation request to the sound generation channels not currently generating sounds, the sound generation channels being assigned to other ports to which an application of the priority lower than the same priority is set.

In the case where the number of new sound generation instruction inputs to an arbitrary port exceeds the number of the sound generation channels to which generators are not assigned in the maximum number of sound generation channels belonging to the port, the channel adjusting procedure assigns the generators corresponding to the sound generation instruction to the sound generation channels which belong to the port and to which generators are not assigned and the sound generation channels which belong to other ports having the application of the same priority set thereto and to which generators are not assigned.

What is claimed is:

1. A sound generation assignment device comprising:

a plurality of sound generation channels to which any of a plurality of generators of a sound source connected thereto is assigned when a sound generation instruction is supplied;

a plurality of input ports to each of which an application of music sound generation is set, and a sound generation instruction from outside is input;

priority setting means for setting a priority to said each port;

maximum channel number setting means for setting the maximum number of sound generation channels assignable to said each port; and channel adjusting means for, in the case where, when there is a new sound generation instruction input to an arbitrary port, there are sound generation channels to which generators are not assigned in the maximum number of sound generation channels belonging to the arbitrary port, assigning the generators corresponding to the sound generation instruction to the sound generation channels to which generators are not assigned; and when generators are assigned to all the sound generation channels, assigning the generators corresponding to the sound generation instruction to the sound generation channels to which generators are not assigned, the sound generation channels belonging to another port to which an application of the same priority as that of the arbitrary port by the priority setting means.

2. A sound generation assignment device according to claim 1, wherein, in the case where, when there is a new sound generation instruction to the arbitrary port, generators are assigned to all of the maximum number of sound generation channels belonging to the arbitrary port, and there is not any other port to which an application of the same priority is set, the channel adjusting means assigns the generators corresponding to the new sound generation instruction to the sound generation channels to which generators have already been assigned in the arbitrary port.

3. A sound generation assignment device according to claim 1, wherein, in the case where generators are assigned to all the sound generation channels in another port to which an application of the same priority is set, the channel adjusting means assigns the generators corresponding to the new sound generation instruction to the sound generation channels to which generators are not assigned, the sound generation channels belonging to another port to which an application of a priority lower than the same priority is set by the priority setting means.

4. A sound generation assignment device according to claim 1, wherein, in the case where the number of new sound generation instruction inputs to an arbitrary port exceeds the number of the sound generation channels to which generators are not assigned in the maximum number of sound generation channels belonging to the arbitrary port, the channel adjusting means assigns the generators corresponding to the sound generation instruction to the sound generation channels which belong to the arbitrary port and to which generators are not assigned and the sound generation channels which belong to another port having the application of the same priority set thereto and to which generators are not assigned.

5. A music sound generator comprising:

a sound source having a plurality of generators which generates music sounds;

a plurality of sound generation channels to which any of the generators of the sound source is assigned when a sound generation instruction is supplied;

a plurality of input ports to each of which an application of music sound generation is set, and a sound generation instruction from outside is input;

priority setting means for setting a priority to said each port;

maximum channel number setting means for setting the maximum number of sound generation channels assignable to said each port; and channel adjusting means for, in the case where, when there is a new sound generation instruction input to an arbitrary port, there are sound generation channels to which generators are not assigned in the maximum number of sound generation channels belonging to the arbitrary port, assigning the generators corresponding to the sound generation instruction to the sound when generators are assigned to all the sound generation channels, assigning the generators corresponding to the sound generation instruction to the sound generation channels to which generators are not assigned, the sound generation channels belonging to another port to which an application of the same priority as that of the arbitrary port by the priority setting means.

6. A music sound generator according to claim 5, wherein, in the case where, when there is a new sound generation instruction to the arbitrary port, generators are assigned to all of the maximum number of sound generation channels belonging to the arbitrary port, and there is not any other port to which an application of the same priority is set, the channel adjusting means assigns the generators corresponding to the new sound generation instruction to the sound generation channels to which generators have already been assigned in the arbitrary port.

7. A music sound generator according to claim 5, wherein, in the case where generators are assigned to all the sound generation channels in another port to which an application of the same priority is set, the channel adjusting means assigns the generators corresponding to the new sound generation instruction to the sound generation channels to which generators are not assigned, the sound generation channels belonging to another port to which an application of a priority lower than the same priority is set by the priority setting means.

8. A music sound generator according to claim 5, wherein, in the case where the number of new sound generation instruction inputs to an arbitrary port exceeds the number of the sound generation channels to which generators are not assigned in the maximum number of sound generation channels belonging to the arbitrary port, the channel adjusting means assigns the generators corresponding to the sound generation instruction to the sound generation channels which belong to the arbitrary port and to which generators are not assigned and the sound generation channels which belong to another port having the application of the same priority set thereto and to which generators are not assigned.

9. A computer readable medium having a music sound generation process program stored thereon for controlling a music sound assignment device comprising a plurality of sound generation channels to each of which any of a plurality of generators of a sound source connected thereto is assigned when a sound generation instruction is supplied, and a plurality of input ports to each of which an application of music sound generation is set and a sound generation instruction from outside is input, wherein the program controls the music sound assignment device to perform:

a priority setting procedure of setting a priority to each set application;

a maximum channel number setting procedure of setting the maximum number of sound generation channels assignable to each port; and a channel adjusting procedure of, in the case where, when there is a new sound generation instruction input to an arbitrary port, there are sound generation channels to which generators are not assigned in the maximum number of sound generation channels belonging to the arbitrary port, assigning the generators corresponding to the sound generation request to the sound generation channels to which generators are not assigned, and when generators are assigned to all the sound generation channels, assigning the generators corresponding to the sound generation request to the sound generation channels to which generators are not assigned, the sound generation channels belonging to another port to which an application of the same priority as that of the arbitrary port.

10. A The computer readable medium according to claim 9, wherein, in the case where, when there is a new sound generation instruction to the arbitrary port, generators are assigned to all of the maximum number of sound generation channels belonging to the arbitrary port, and there is not any other port to which an application of the same priority is set, the channel adjusting procedure assigns the generators corresponding to the new sound generation instruction to the sound generation channels to which generators have already been assigned in the arbitrary port.

11. A The computer readable medium according to claim 9, wherein, in the case where generators are assigned to all the sound generation channels in another port to which an application of the same priority is set, the channel adjusting procedure assigns the generators corresponding to the new sound generation instruction to the sound generation channels to which generators are not assigned, the sound generation channels belonging to another port to which an application of a priority lower than the same priority is set.

12. A The computer readable medium according to claim 9, wherein, in the case where the number of new sound generation instruction inputs to an arbitrary port exceeds the number of the sound generation channels to which generators are not assigned in the maximum number of sound generation channels belonging to the arbitrary port, the channel adjusting procedure assigns the generators corresponding to the sound generation instruction to the sound generation channels which belong to the arbitrary port and to which generators are not assigned and the sound generation channels which belong to another port having the application of the same priority set thereto and to which generators are not assigned.

* * * * *